US006438905B2

(12) United States Patent
Constantinou

(10) Patent No.: US 6,438,905 B2
(45) Date of Patent: Aug. 27, 2002

(54) HIGHLY EFFECTIVE SEISMIC ENERGY DISSIPATION APPARATUS

(75) Inventor: Michael C. Constantinou, Amherst, NY (US)

(73) Assignee: The Research Foundation of SUNY at BUffalo, Amherst, NY (US)

( * ) Notice: Subject to any disclaimer, the term of this patent is extended or adjusted under 35 U.S.C. 154(b) by 7 days.

(21) Appl. No.: 09/819,191

(22) Filed: Mar. 28, 2001

Related U.S. Application Data

(60) Provisional application No. 60/193,130, filed on Mar. 29, 2000.

(51) Int. Cl.[7] ..... E04H 9/02
(52) U.S. Cl. ..... 52/167.3; 52/167.4; 52/1
(58) Field of Search ..... 52/167.1, 167.3, 52/167.4, 1; 248/636, 638

(56) References Cited

U.S. PATENT DOCUMENTS 4,644,714 A 2/1987 Zayas ..... 52/167
4,922,667 A 5/1990 Kobori et al. ..... 52/167
5,177,915 A 1/1993 Kobori et al. ..... 52/167
5,462,141 A 10/1995 Taylor ..... 188/280
5,771,518 A 6/1998 Roberts ..... 14/73.1
5,870,863 A 2/1999 Taylor ..... 52/167.3

FOREIGN PATENT DOCUMENTS

JP 1284639 11/1989

*Primary Examiner*—Carl D. Friedman
*Assistant Examiner*—Naoko N Slack
(74) *Attorney, Agent, or Firm*—Simpson & Simpson, PLLC

(57) ABSTRACT

An energy dissipation apparatus for installation in structural frames to mitigate seismic effects comprises a scissor-jack system of braces with an energy dissipation device such as a viscous, viscoelastic, or hysteretic damper, or an active or semi-active device, connected between opposing pivot joints of the scissor-scissor jack system. The scissor jack system magnifies displacement so that energy is dissipated more effectively by the damper. Open bay, diagonal, and alternative installation arrangements with respect a structural frame are disclosed.

14 Claims, 8 Drawing Sheets

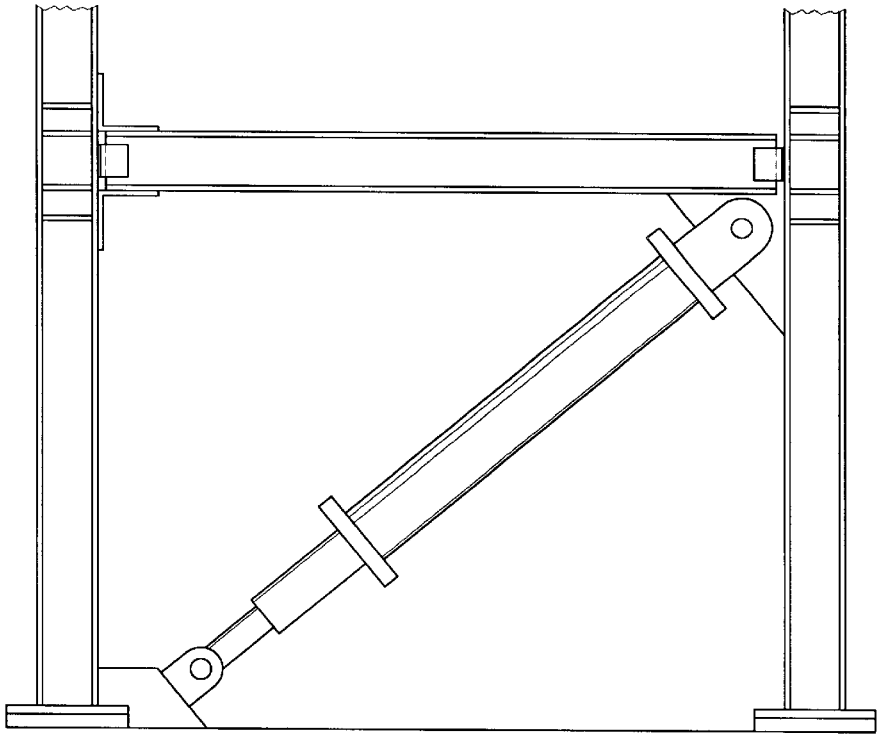
FIG. 1 - PRIOR ART
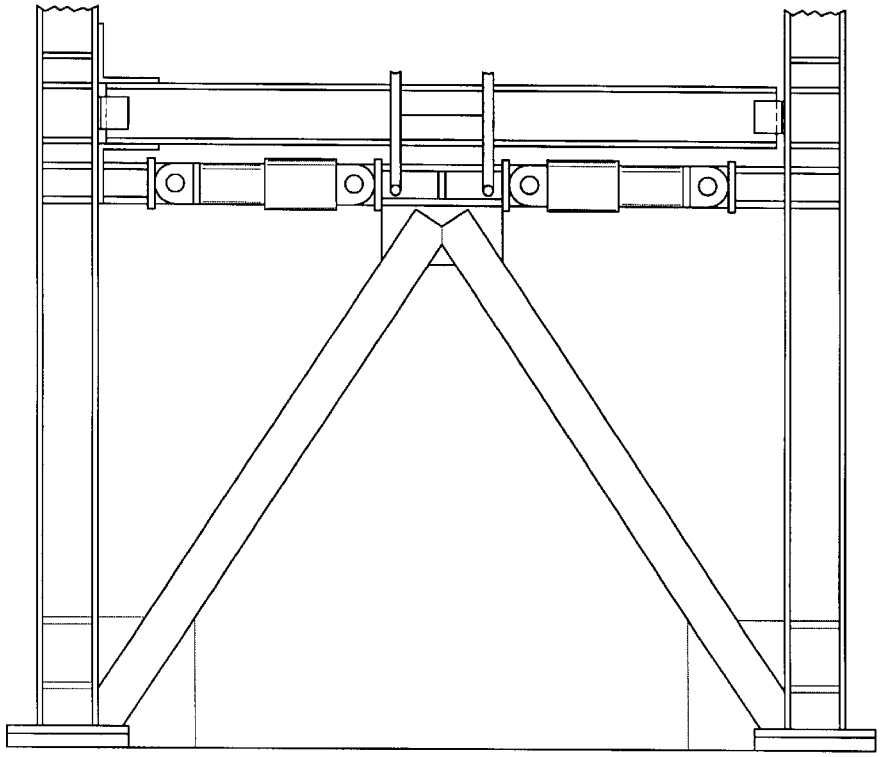
FIG. 2 - PRIOR ART $\Theta = 45^o$
$\beta = 0.021$
$f = 0.707$ $\beta = 0.043$
$f = 1.0$ $\Theta = 70^o$, $\Psi = 9^o$
$\beta = 0.200$
$f = 2.159$ $\Theta = 45^o$, $\Psi = 14^o$
$\beta = 0.344$
$f = 2.836$ AMPLITUDE OF TRANSFER FUNCTION OF TESTED STRUCTURE WITH AND WITHOUT SCISSOR-JACK DAMPER SYSTEM

HIGHLY EFFECTIVE SEISMIC ENERGY DISSIPATION APPARATUS

CROSS-REFERENCE TO RELATED APPLICATIONS

The present application claims benefit under 35 U.S.C. §119(e) of U.S. Provisional Patent Application Serial No. 60/193,130 filed Mar. 29, 2000, which application is hereby incorporated by reference in the present application.

BACKGROUND OF THE INVENTION

A. Field of the Invention

The present invention relates to the field of building design and construction, and more particularly to energy dissipating devices for inclusion in structural systems to protect the structure in the event of an earthquake.

B. Description of the Prior Art

The technology of seismic energy dissipation is based on the introduction of energy dissipation devices within a structural system so that seismic drift is reduced to within acceptable limits. This approach offers improved performance of the structural system to a level better than life safety, which is currently implied in the building codes. Many owners of essential and critical facilities, and of architecturally significant structures, opt for the use of this technology for achieving a performance level suitable for immediate occupancy of the structure. The approach alternatively offers a reduction of seismic drift to within limits mandated by building codes without increase in the stiffness and strength of the structural system. This does not always improve the performance level, but may either reduce the cost of new structures or allow for cost-effective rehabilitation of existing structures.

Engineers are familiar with and have so far exclusively used diagonal (FIG. 1) and chevron (FIG. 2) brace configurations for the delivery of forces from energy dissipation devices to the structural frame. Such configurations have disadvantages that inhibit the use of energy dissipation systems. More specifically, they typically occupy an entire bay in a frame and thus interfere with open space and other architectural requirements, and they are inapplicable to stiff structural frames due to small damper displacements where large damping forces are required, thus leading to expensive damper designs.

FIGS. 1 and 2 show diagonal and chevron brace configurations for the attachment of energy dissipation devices to a structural system. Detailed information on the status of this technology and its applications may be found in the monograph "Passive Energy Dissipation Systems for Structural Design and Retrofit" by M. C. Constantinou et al., 1998. The ineffectiveness of these configurations for stiff structural systems is well recognized and best described in the following statement from a building code:

> "structural systems best suited for implementation of energy dissipation devices are the moment-resisting frame and the flexible dual system, in either structural steel or reinforced concrete. The interstory response of a stiff lateral load-resisting system, such as a reinforced concrete shear wall system or a steel-braced dual system, is generally characterized by both small relative velocities and small relative displacements. As such it may not be feasible to implement supplemental energy dissipation."

Moreover, it is known that the use of energy dissipation systems has been rejected in some projects by architects concerned with interferences of the system with the desire for open space.

Energy dissipation systems installed for the improvement of the seismic performance of a structure may be ineffective in reducing wind-induced vibration. Wind-induced vibration is typically small in amplitude so that it is often ineffective, in terms of either performance or cost, to design wind energy dissipation systems within the diagonal or chevron brace configurations.

U.S. Pat. No. 5,870,863 describes a toggle linkage for incorporation into a structural frame to improve the seismic performance of the structure. The described toggle linkage comprises a first link including a damper mechanism, and second and third links that do not include damper mechanisms. All three links are coplanar, with a first end of each link being located at a different area of the structural frame. The second ends of the three links are connected proximate to each other, and a metal plate provides flexible connection between the second ends of the second and third links for allowing flexure within the plane of the linkage but prevents out-of-plane buckling of the linkage in the event of an earthquake. While the toggle linkage may be configured to perform better than the diagonal and chevron brace configurations, it also requires an entire bay for installation and, thus, it interferes with the aforementioned open space requirements.

SUMMARY OF THE INVENTION

Consequently, it is an object of the present invention to provide an energy dissipation system configuration that is applicable to stiff structural systems, or generally to systems with small structural deformations.

It is a related object of the present invention to provide an energy dissipation apparatus that can be installed in a nearly vertical configuration or at beam-to-column joints.

The energy dissipation apparatus of the present invention effectively bypasses the limitations of the diagonal and chevron brace configurations, and accordingly has an extended range of applicability.

In a preferred embodiment of the present invention, the energy dissipation apparatus comprises a scissor-jack system of braces with an energy dissipation device such as a viscous, viscoelastic, or hysteretic damper, or an active or semi-active device, connected between opposing pivot joints of the scissor-scissor jack system. The scissor jack system magnifies displacement so that energy is dissipated by the damper with a reduced requirement for damper force. The scissor jack system also magnifies the damper force through a shallow truss configuration and then delivers it to the structural frame.

BRIEF DESCRIPTION OF THE DRAWINGS

The nature and mode of operation of the present invention will now be more fully described in the following detailed description of the preferred embodiments taken with the accompanying drawing figures, in which:

FIG. 1 shows a diagonal brace configuration of the prior art;

FIG. 2 shows a chevron brace configurations of the prior art;

DETAILED DESCRIPTION OF THE INVENTION

Figure 3:
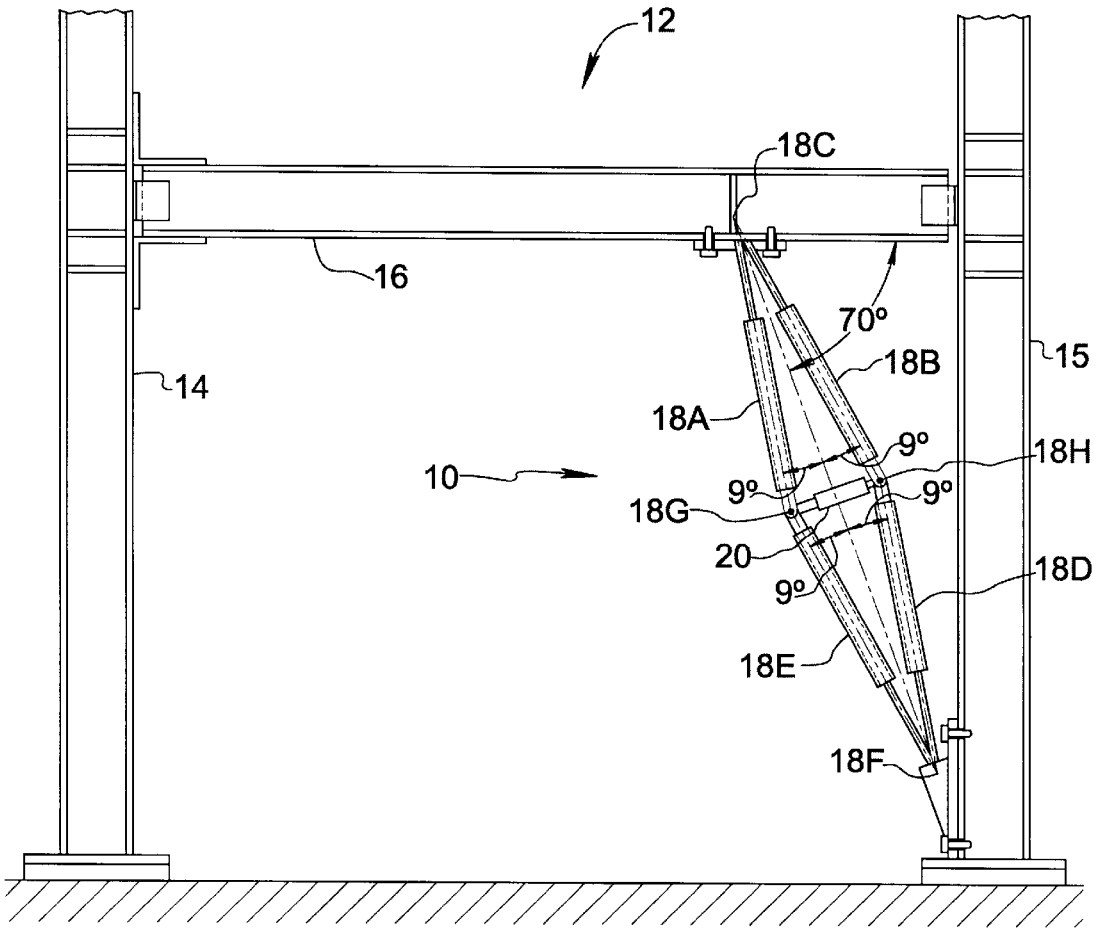
FIG. 3 is an elevational view showing an energy dissipation apparatus formed in accordance with a preferred embodiment of the present invention.

Reference is now directed to FIG. 3 of the drawings, wherein an energy dissipation apparatus formed in accordance with a preferred embodiment of the present invention is shown and designated generally by the reference numeral 10. Apparatus 10 is illustrated in FIG. 3 installed in a structural frame 12 having columns 14 and 15 joined by beam 16. The near-vertical installation arrangement of apparatus 10, for example at 70° degrees from horizontal as shown in FIG. 3, is termed an "open-bay" configuration due to the desirable open space remaining in the structural bay. Apparatus 10 comprises a scissor-jack system having members 18A and 18B linked at first end 18C, and opposite members 18D and 18E linked at second end 18F. Members 18A and 18E are pivotally linked at pivot joint 18G, while members 18B and 18D are pivotally linked at pivot joint 18H opposite pivot joint 18G. An energy dissipation device 20, which can be a viscous, viscoelastic, or hysteretic damper, or an active or semi-active device, is connected between pivot joints 18G and 18H to act with respect to displacements of such pivot joints. First end 18C is mounted to beam 16 at a location spaced horizontally from corresponding column 15, while second end 18F is mounted to column 15 at a location spaced vertically from beam 16. The connections of members 18A and 18B at 18C and of members 18D and 18E at 18F are either standard structural simple connections with long plates as shown in FIG. 3 or are true pivots. For the geometry shown in FIG. 3, it will be appreciated that the scissor-jack system defines a shallow truss system with members 18A–18D each angularly displaced by a small angle (for example 9 degrees in FIG. 3) from a major axis defined by first and second ends 18C and 18F. Accordingly, the required damping force for effective energy dissipation is relatively small.

The performance of apparatus 10 is best described with reference to FIGS. 4A–4D, wherein various configurations are compared. More specifically, the displacement magnification factor, defined as the ratio of damper displacement to story drift, is computed for diagonal, chevron, scissor-jack open bay, and scissor-jack diagonal configurations respectively. The structural frame 12 in each of FIGS. 4A–4D has a period T=0.3 seconds and a supported load W=137 kN. Each brace configuration utilizes a viscous damper having a damping coefficient $C_0$=25 Ns/mm. Damper displacement $u_D$ is simply expressed $$u_D = f\,u$$

where f is the displacement magnification factor and u is the story drift. Lateral damping force $F_{LD}$ is computed as follows:

$$F_{LD} = C_0 f^2 \dot{u}$$

The damping ratio, β is given by the following relation:

$$\beta = \frac{C_0 f^2 g T}{4\pi W}$$

where g is the acceleration due to gravity.

Figure 4A:
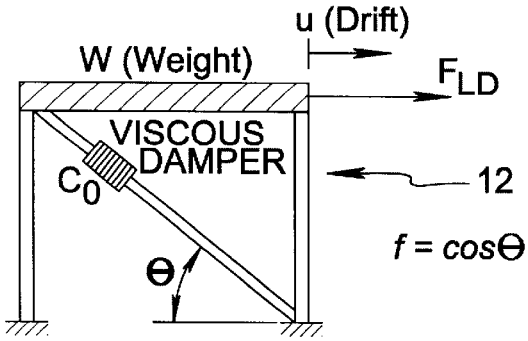
FIG. 4A PRIOR ART
FIG. 4A is a schematic view for establishing mathematical nomenclature describing a diagonal brace and damper configuration of the prior art.
Figure 4B:
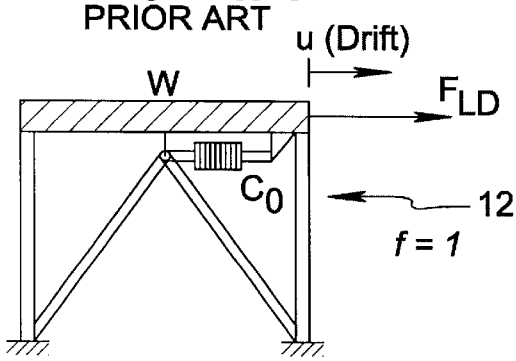
FIG. 4B PRIOR ART
FIG. 4B is a schematic view for establishing mathematical nomenclature describing a chevron brace and damper configuration of the prior art.

In FIG. 4A, the prior art diagonal brace/damper apparatus is at a 45 degree diagonal such that displacement magnification factor f is simply equal to the cosine of 45 degrees, that is 0.707. The damping ratio β for the system in FIG. 4A is 0.021. In the prior art chevron brace system of FIG. 4B, displacement magnification factor f is 1.0 and damping ratio β is 0.043. Looking now at the open bay scissor-jack configuration of FIG. 4C, which uses the geometry previously described with respect to FIG. 3, f is calculated as follows:

$$f = \frac{\cos(\theta)}{\tan(\Psi)}$$

where θ is the angle of the major axis of the scissor-jack from horizontal, and Ψ is the truss angle. Consequently, for θ=70 degrees and Ψ=9 degrees, the damping ratio β is 0.200 and the displacement magnification factor f is 2.159, more than double the value for the chevron brace system of the prior art. In the more effective diagonal scissor-jack configuration shown in FIG. 4D, θ=45 degrees and Ψ=14 degrees, such that β=0.344 and f equals 2.836. System effectiveness is determined by the value of the displacement magnification factor f however very high values of this factor are not desired because of the resulting sensitivity of the system.

The effect of the displacement magnification factor f is evident from the above equation for the contribution of the lateral damping force $F_{LD}$ to the lateral force of the system, and the equation giving the damping ratio β, in which the square of f appears. These equations apply only for systems with viscous energy dissipation devices, but they demonstrate the effectiveness of apparatus 10. Higher values of the damping ratio β denote greater effectiveness in reducing drift. Typically, a damping ratio value in the range of 0.2 to 0.3 is desired, whereas a value of 0.05 is insufficient to produce any significant effect. It is evident from comparison of FIGS. 4A–4D, in which the same viscous damper is used with respect to the same structural frame, that the scissor-jack configurations of FIGS. 4C and 4D achieve higher damping ratio values than the prior art diagonal and chevron configurations of FIGS. 4A and 4B.

Figure 5:
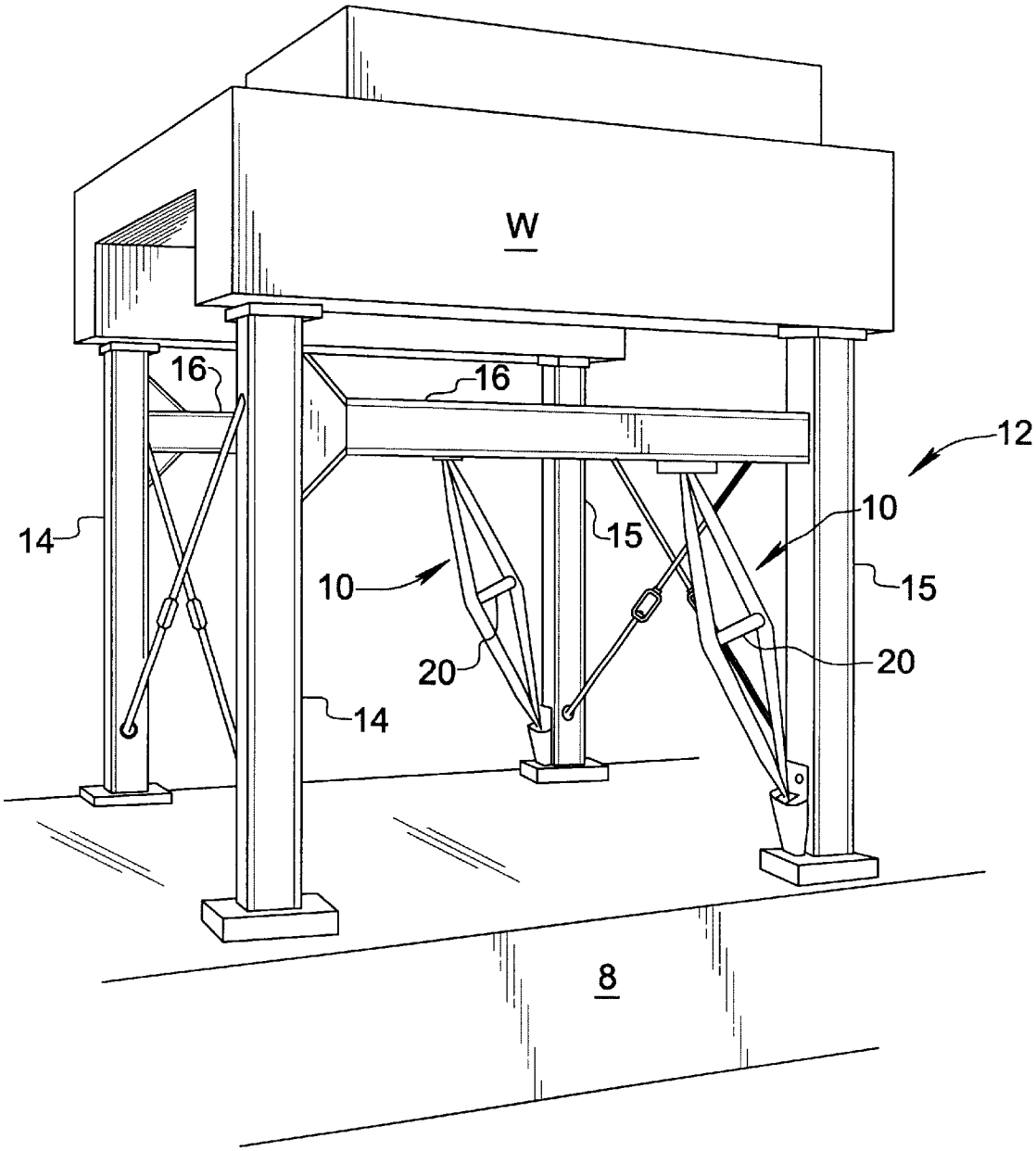
FIG. 5 is a perspective view showing the energy dissipation apparatus of the present invention installed in a test structure mounted on a shake table.
Figure 6:
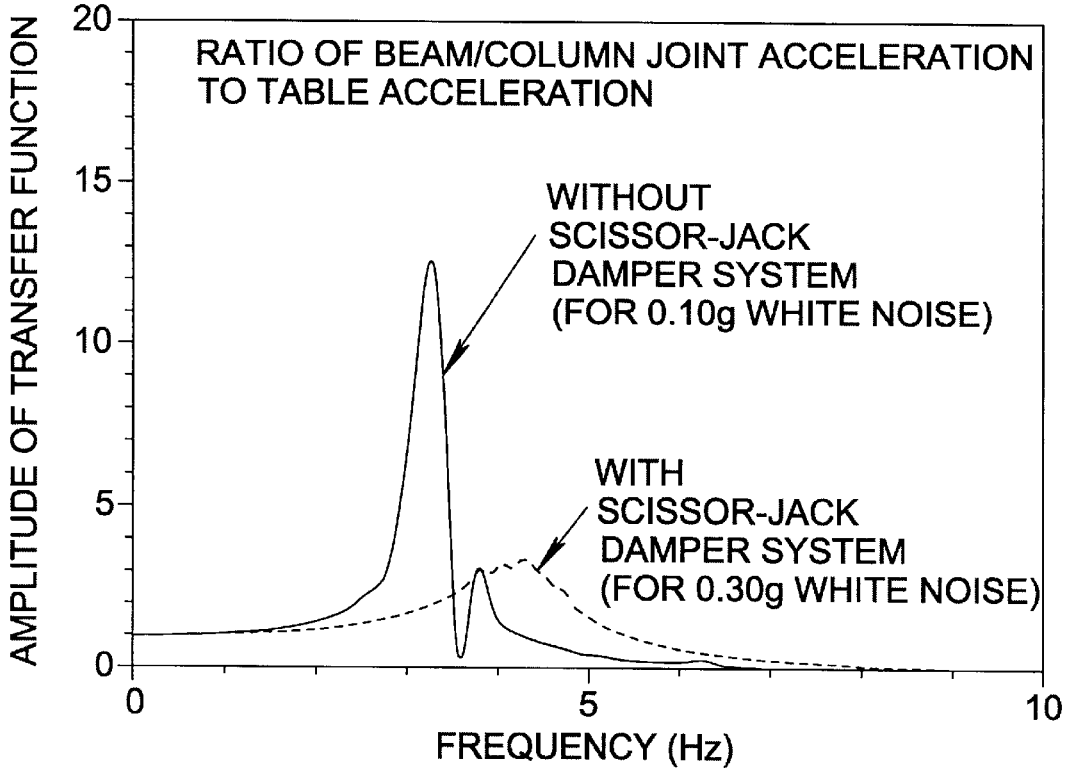
FIG. 6 is a graph comparing the amplitude of a structural transfer function of the test structure shown in FIG. 5 with and without the energy dissipation apparatus of the present invention.

FIG. 5 shows a view of a model structure 12 mounted on a shake table 8, with an energy dissipation apparatus 10 of the present invention installed in an open bay configuration at a pair of beam-column joints. The slenderness of the system and the small size of the damper 20 are apparent. FIG. 6 shows transfer functions obtained in the testing of the system depicted in FIG. 5 which demonstrate the effects of energy dissipation apparatus 10. In particular, an increase in damping is manifested by a reduction of amplitude, and an increase in natural frequency occurs. Interestingly, the latter is caused by the flexibility of the system, which causes a component of the viscous damping force to occur in-phase with the restoring force.

Figure 4C:
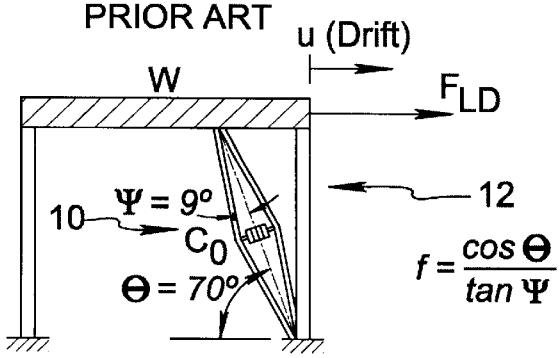
FIG. 4C is a schematic view for establishing mathematical nomenclature describing a scissor-jack brace and damper apparatus of the present invention installed in an open bay arrangement.
Figure 4D:
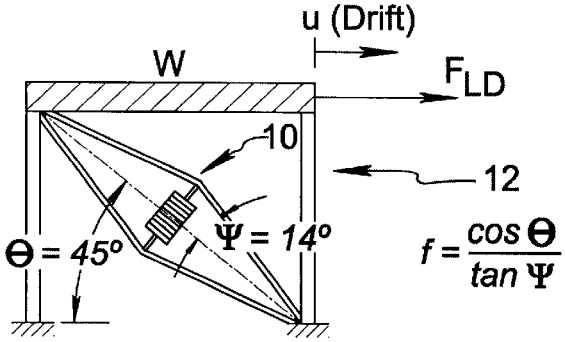
FIG. 4D is a schematic view for establishing mathematical nomenclature describing a scissor-jack brace and damper apparatus of the present invention installed in a diagonal arrangement.
Figure 7:
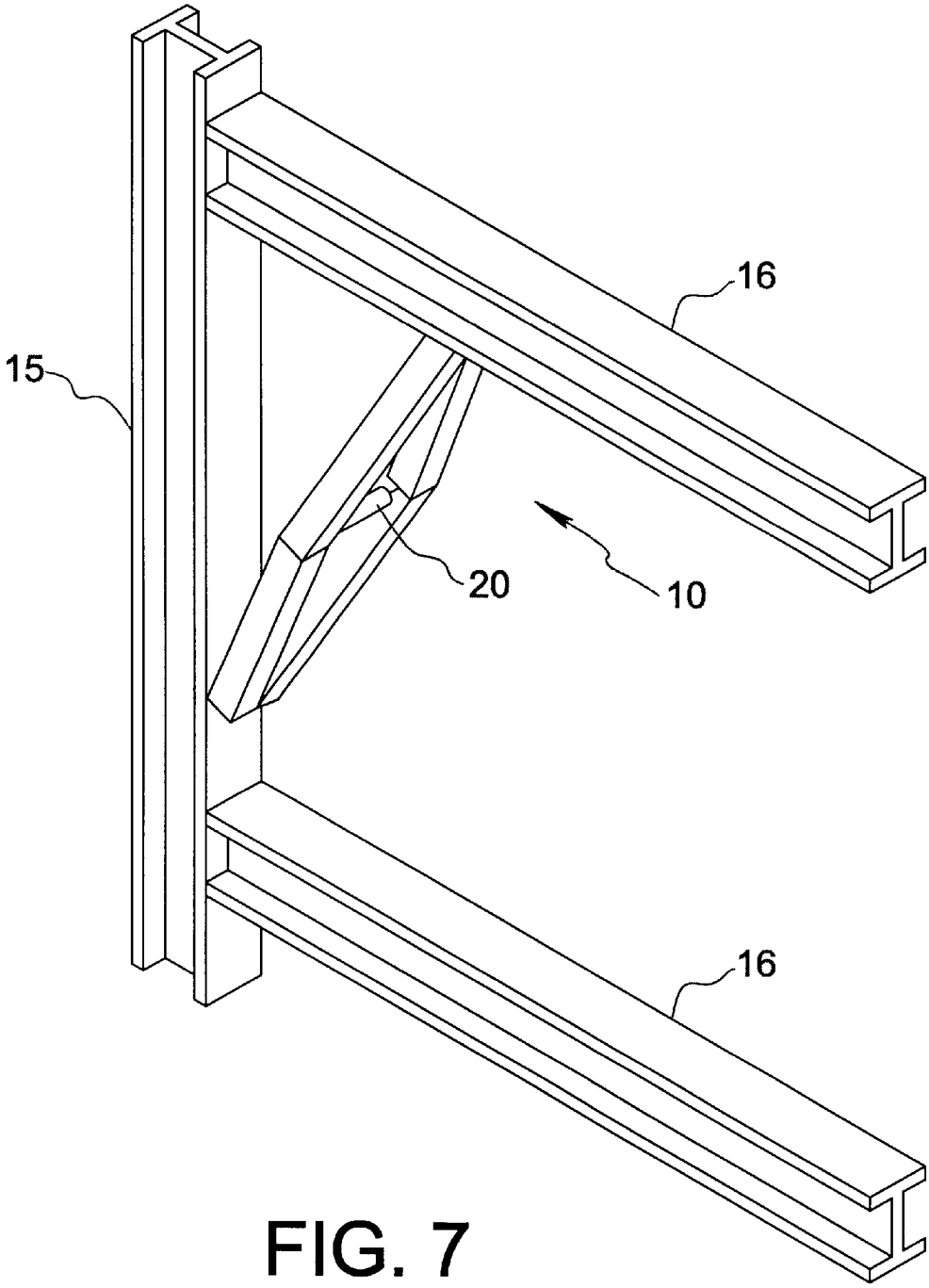
FIG. 7 is a schematic perspective view showing the energy dissipation apparatus of the present invention installed in an alternative orientation at a beam-column joint.
Figure 8:
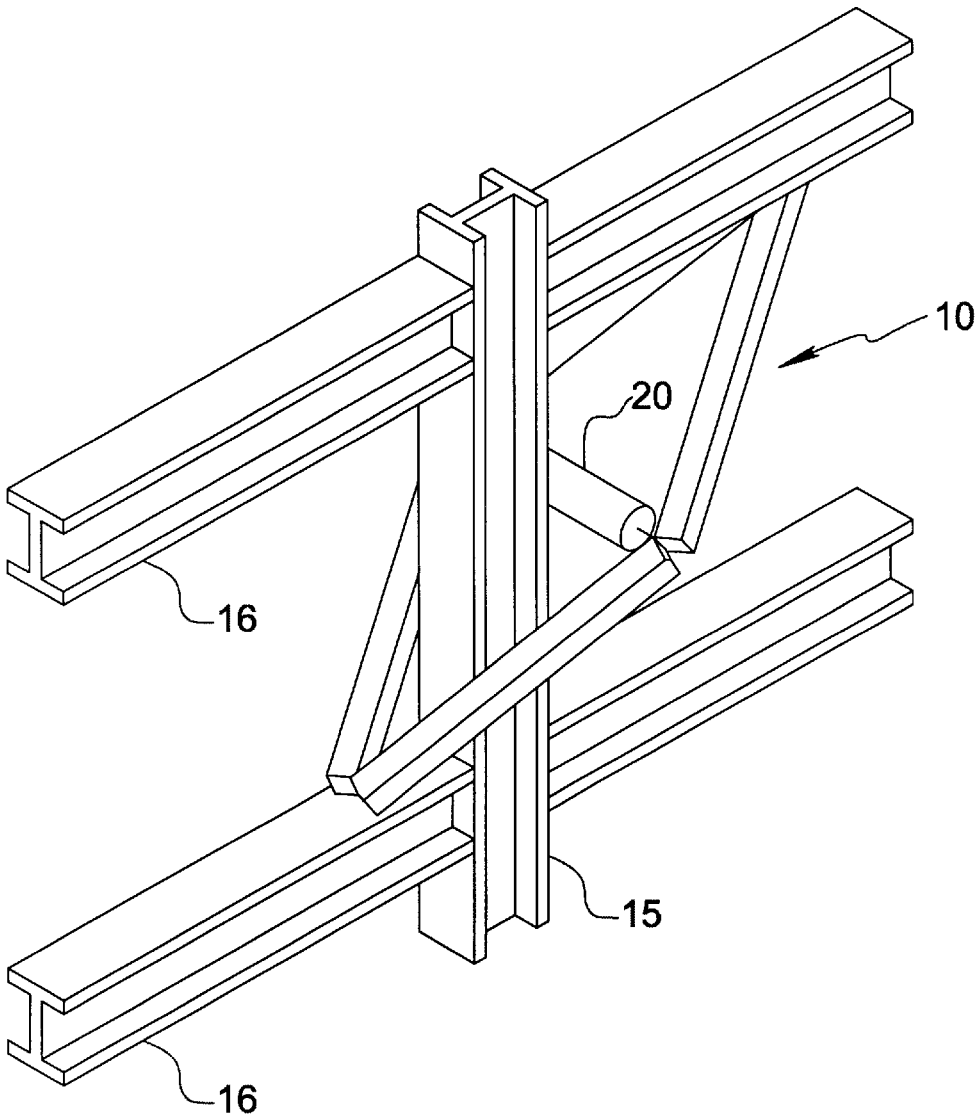
FIG. 8 is a schematic perspective view showing an alternative installation arrangement of the energy dissipation apparatus around a column.
Figure 9:
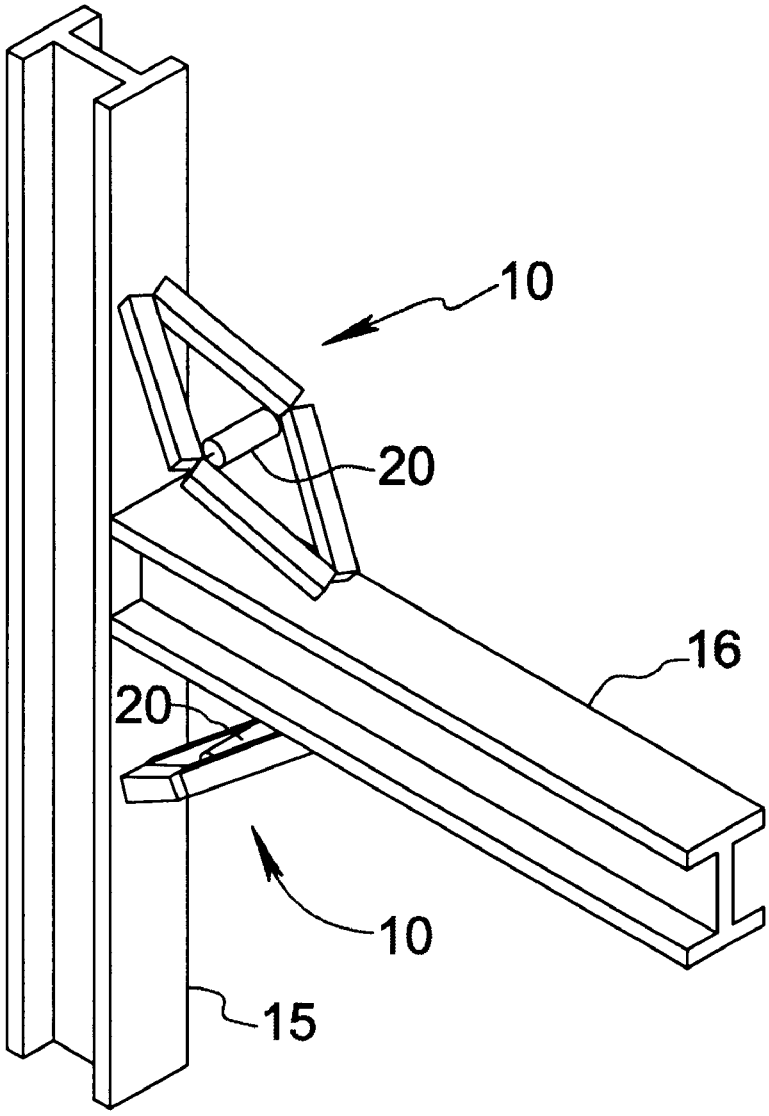
FIG. 9 is a schematic perspective view showing more than one energy dissipation apparatus of the present invention installed at the same beam-column joint.

It is recalled that FIGS. 3, 4C, and 5 show an "open bay" installation of apparatus 10 having a large angle of inclination, and FIG. 4D shows a "diagonal" installation of apparatus 10 having a somewhat lower angle of inclination. However, the energy dissipation apparatus 10 of the present invention can be implemented in several other ways. For example, FIG. 7 shows a configuration in which apparatus 10 is rotated 90 degrees about its major axis. This rotated alternative enables apparatus 10 to be installed around a column 15 as illustrated in FIG. 8. Moreover, apparatus 10 may be made in smaller sizes for installation on opposite sides of a beam-column joint, as shown in FIG. 9, and at column bases. Apparatus 10 may also be installed vertically between beams 16 in order to reduce floor vibration.

It will be appreciated from the above description that the energy dissipation apparatus of the present invention is advantageously applicable to stiff structures and to structures undergoing small interstory drifts such as under wind-induced vibration, is highly effective so that it can be made with low output force damping devices, and occupies little space so as not to interfere with open space and other architectural requirements.

What is claimed is:

1. An apparatus for installation in a structure to dissipate seismic energy transmitted to said structure, said apparatus comprising:

a first end and a second end opposite said first end;

a first pair of elongated members extending from said first end, said first pair of elongated members being equal to each other in operative length;

a second pair of elongated members extending from said second end, said second pair of elongated members being equal to each other in operative length;

a first pivot joint for pivotally connecting a distal end of one of said first pair of elongated members to a distal end of one of said second pair of elongated members;

a second pivot joint opposite said first pivot joint for pivotally connecting a distal end of the other of said first pair of elongated members to a distal end of the other of said second pair of elongated members; and an energy dissipating device connected between said first pivot joint and said second pivot joint for dissipating energy incident to displacement occurring between said first pivot joint and said second pivot joint.

2. The apparatus according to claim 1, wherein said energy dissipating device is a viscous damper.

3. The apparatus according to claim 1, wherein said energy dissipating device is a viscoelastic damper.

4. The apparatus according to claim 1, wherein said energy dissipating device is a hysteretic damper.

5. The apparatus according to claim 1, wherein said energy dissipating device is an active or semi-active device.

6. The apparatus according to claim 1, wherein said first pair of elongated members diverge from said first end by a shallow truss angle.

7. The apparatus according to claim 6, wherein said truss angle is approximately nine degrees.

8. The apparatus according to claim 1, wherein said second pair of elongated members diverge from said second end by a shallow truss angle.

9. The apparatus according to claim 8, wherein said truss angle is approximately nine degrees.

10. The apparatus according to claim 1, wherein said operative length of said first pair of elongated members is equal to said operative length of said second pair of elongated members.

11. A structure adapted for seismic excitation, said structure comprising:

a beam;

a column connected to said beam; and an apparatus for dissipating seismic energy, said apparatus comprising:

a first end fixed to said beam at a location spaced from said column;

a second end fixed to said column at a location spaced from said beam;

a first pair of elongated members extending from said first end, said first pair of elongated members being equal to each other in operative length;

a second pair of elongated members extending from said second end, said second pair of elongated members being equal to each other in operative length;

a first pivot joint for pivotally connecting a distal end of one of said first pair of elongated members to a distal end of one of said second pair of elongated members;

a second pivot joint opposite said first pivot joint for pivotally connecting a distal end of the other of said first pair of elongated members to a distal end of the other of said second pair of elongated members; and an energy dissipating device connected between said first pivot joint and said second pivot joint for dissipating energy incident to displacement occurring between said first pivot joint and said second pivot joint.

12. The structure according to claim 11, wherein said first pair of elongated members and said second pair of elongated members are arranged coplanar with said beam and said column.

13. The structure according to claim 11, wherein said first pair of elongated members and said second pair of elongated members are arranged non-coplanar with said beam and said column.

14. A structure adapted for seismic excitation, said structure comprising:

a first beam and a second beam spaced from said first beam;

a column connected to said first beam and said second beam; and an apparatus for dissipating seismic energy, said apparatus comprising:

a first end fixed to said first beam at a location spaced from said column;

a second end fixed to said second beam at a location spaced from said column;

a first pair of elongated members extending from said first end, said first pair of elongated members being equal to each other in operative length;

a second pair of elongated members extending from said second end, said second pair of elongated members being equal to each other in operative length;

a first pivot joint for pivotally connecting a distal end of one of said first pair of elongated members to a distal end of one of said second pair of elongated members;

a second pivot joint opposite said first pivot joint for pivotally connecting a distal end of the other of said first pair of elongated members to a distal end of the other of said second pair of elongated members; and an energy dissipating device connected between said first pivot joint and said second pivot joint for dissipating energy incident to displacement occurring between said first pivot joint and said second pivot joint;

wherein said column is surrounded by said first pair of elongated members and said energy dissipating device.

* * * * *